US011817283B2

(12) United States Patent
Harrer et al.

(10) Patent No.: US 11,817,283 B2
(45) Date of Patent: Nov. 14, 2023

(54) ELECTRICAL SWITCHING SYSTEM

(71) Applicant: Ellenberger & Poensgen GmbH, Altdorf (DE)

(72) Inventors: Hubert Harrer, Hilpoltstein (DE); Hendrik-Christian Koepf, Nuremberg (DE); Klaus Loos, Winkelhaid (DE); Klaus Werner, Roethenbach (DE); Juergen Zeberl, Lauterhofen (DE)

(73) Assignee: Ellenberger & Poensgen GmbH, Altdorf (DE)

( * ) Notice: Subject to any disclaimer, the term of this patent is extended or adjusted under 35 U.S.C. 154(b) by 33 days.

(21) Appl. No.: 17/567,418

(22) Filed: Jan. 3, 2022

(65) Prior Publication Data

US 2022/0122798 A1 Apr. 21, 2022

Related U.S. Application Data

(63) Continuation of application No. PCT/EP2020/060671, filed on Apr. 16, 2020.

(30) Foreign Application Priority Data

Jul. 3, 2019 (DE) ..... 10 2019 209 745.6

(51) Int. Cl.
*H01H 71/08* (2006.01)

(52) U.S. Cl.
CPC ..... *H01H 71/082* (2013.01)

(58) Field of Classification Search
CPC ..... H01H 71/082; H01H 1/54; H01H 50/54
USPC ..... 307/113
See application file for complete search history.

(56) References Cited

U.S. PATENT DOCUMENTS 11,120,963 B2 9/2021 Ziegler
2014/0353136 A1 12/2014 Von Prondzinski et al.

FOREIGN PATENT DOCUMENTS

DE 1 734 691 U 11/1956
DE 1 145 698 B 3/1963
(Continued)

OTHER PUBLICATIONS

Machine Translation of Kondo Japanese Patent Document JP 2531617 B2 Sep. 1996 (Year: 1996).*
(Continued)

*Primary Examiner* — Kevin J Comber
(74) *Attorney, Agent, or Firm* — Muncy, Geissler, Olds & Lowe, P.C.

(57) ABSTRACT

An electrical switching system of a circuit breaker, with a first busbar extending in a longitudinal direction, which carries a first contact and a second contact spaced apart therefrom in the longitudinal direction, and which has a first power connection, and with a second busbar extending in the longitudinal direction, which carries a first counterpart contact and a second counterpart contact spaced apart therefrom in the longitudinal direction, and which has a second power connection. The second busbar is mounted so as to be movable in a transverse direction perpendicular to the longitudinal direction, wherein the first busbar partially overlaps the second busbar along the longitudinal direction. In the longitudinal direction, the contacts and the counterpart contacts are arranged between the two power connections in the overlap region.

8 Claims, 2 Drawing Sheets

(56) References Cited

FOREIGN PATENT DOCUMENTS

| | | | | | |
|---|---|---|---|---|---|
| DE | 1 894 372 | U | | 6/1964 | |
| DE | 1 173 168 | B | | 7/1964 | |
| DE | 25 16 595 | A1 | | 10/1976 | |
| DE | 11 2005 002 227 | T5 | | 10/2007 | |
| DE | 112005002227 | T5 | * | 10/2007 | ..... H01H 1/54 |
| DE | 10 2011 118 894 | B3 | | 1/2013 | |
| DE | 10 2017 220 503 | B3 | | 1/2019 | |
| EP | 2533262 | A1 | * | 12/2012 | ..... H01H 50/56 |
| GB | 1 076 383 | | | 7/1967 | |
| GB | 2 418 780 | A | | 4/2008 | |
| JP | S 47-6864 | Y1 | | 3/1972 | |
| JP | S 59-151708 | A | | 8/1984 | |
| JP | 2531617 | B2 | * | 9/1996 | |
| JP | 2012-199142 | A | | 10/2012 | |
| JP | 2012199142 | A | * | 10/2012 | |
| JP | 2018107046 | A | * | 7/2018 | ..... H01H 1/54 |
| KR | 2014005979 | A | * | 1/2014 | ..... H01H 1/32 |

OTHER PUBLICATIONS

Machine Translation of Uodome Japanese Patent Document JP 2012199142 A Oct. 2012 (Year: 2012).*
Machine Translation of Nishimura Korean Patent Document KR 2014005979 A Jan. 2014 (Year: 2014).*
Machine Translation of Fukuda Japanese Patent Document JP 2018107046 A Jul. 2018 (Year: 2018).*
Machine Translation of Brighton German Patent Document DE 112005002227 T5 Oct. 2007 (Year: 2007).*

* cited by examiner

ELECTRICAL SWITCHING SYSTEM

This nonprovisional application is a continuation of International Application No. PCT/EP2020/060671, which was filed on Apr. 16, 2020, and which claims priority to German Patent Application No. 10 2019 209 745.6, which was filed in Germany on Jul. 3, 2019, and which are both herein incorporated by reference.

BACKGROUND OF THE INVENTION

Field of the Invention

The present invention relates to an electrical switching system having a first bus bar and a second bus bar. The invention further relates to a circuit breaker comprising such an electrical switching system.

Description of the Background Art

Circuit breakers usually have an electrical switching system. The electrical switching system is usually mechanical, so that galvanic isolation can also be implemented. In this case, the electrical switching system usually has a contact as well as a counterpart contact that is movably mounted with respect to it. In particular, the contact and the counterpart contact are each connected to a busbar, wherein the mounting usually is achieved by means of the busbars. If the circuit breaker is in the closed state, i.e. current can be conducted by means of the circuit breaker, the contact rests on the counterpart contact, so that there is a direct mechanical connection between them. An electric current flows via the contact and the counterpart contact.

To ensure that the contact is separated from the counterpart contact as quickly as possible in the event of an overload, one of the busbars is usually C-shaped at the end, wherein the contact or respectively the counterpart contact is arranged on the free end. As a result, in the immediate vicinity of the contact as well as the counterpart contact, the electric current in the two busbars flows in the same direction. Therefore, the two busbars repel each other due to the resulting magnetic fields, wherein the effect grows quadratically with the electric current. If an overcurrent now exists, spacing of the two busbars from each other is facilitated due to the acting magnetic fields.

However, if a comparatively strong electric current occurs, it is possible that an uncontrolled spacing of the two busbars occurs, and/or that an arc is formed between the contact and respectively the counterpart contact, which leads to a burn-off of the contact or respectively the counterpart contact. Thus, a partial melting of the contact or respectively the counterpart contact takes place. In this case, it is possible that liquid material of the contact or respectively the counterpart contact is dissolved and splashes onto other components of the circuit breaker, causing damage to these. If the arc is extinguished, electric current flow between the two busbars will cease and there will be no magnetic forces acting. As a result, if the mechanics of the circuit breaker are comparatively simple, it is possible for the counterpart contact to fall on the contact again, or at least for them to touch each other mechanically again. However, since these are partially liquefied on the surface, a fusion of the contact with the counterpart contact takes place, which is why it is no longer possible to distance them after cooling. If the fault case continues to exist, the circuit breaker will continue to conduct an electric current, which can lead to a damage of the component protected by the circuit breaker. The circuit breaker can also no longer be used, as tripping is no longer possible due to the fusion of the contact with the counterpart contact, i.e. an intentional interruption of the electric current flow.

SUMMARY OF THE INVENTION

It is therefore an object of the present invention to provide a particularly suitable electrical switching system as well as a particularly suitable circuit breaker, wherein advantageously wear is reduced and/or reliability is increased.

With regard to the electrical switching system, this task is solved by the features of claim 1 and with regard to the circuit breaker by the features of claim 8. Advantageous further developments and embodiments are the subject of the respective subclaims.

The electrical switching system is used to conduct and interrupt an electric current. The electrical switching system is suitable, in particular provided and arranged for this purpose. Additionally, the electrical switching system is suitably mechanically configured. Preferably, a rated current conducted by means of the electrical switching system is between 1 A and 125 A, expediently between 1 A and 30 A, between 30 A and 60 A or between 60 A and 100 A. The electrical switching system is suitable, in particular provided and arranged, for conducting an alternating electric current, which has in particular an electrical voltage of between 100 V and 800 V and, for example, of 277 V, 480 V or 600 V. Alternatively, the electrical switching system is suitable, in particular provided and arranged, to conduct a direct electric current, in which case the electrical voltage is in particular between 100V and 1,500V. Preferably, the electrical switching system is used in an industrial plant, in particular in industrial automation. Alternatively, the switching system is a component of a building installation.

The electrical switching system has a first busbar and a second busbar, each of which extends in a longitudinal direction. In other words, the two busbars are arranged parallel to each other. The first busbar carries a first contact and a second contact, which are longitudinally spaced apart from each other. Expediently, the spacing is greater than 4 mm, 5 mm or 1 cm. For example, the spacing is less than 5 cm, 4 cm or 3 cm. For example, the spacing is substantially equal to 2 cm, and in each case, there is in particular a deviation of up to 10%, 5% or 0%. Furthermore, the first busbar has a first power connection. The first power connection is used for electrically contacting the first busbar with further components of the electrical switching system or components of the desired application area. Particularly, the first power connection is implemented by means of a clip or the like. Alternatively, the first power connection is formed on the possible further components, so that the first busbar merges into the further component at the first power connection. Expediently, the first power connection forms one end of the first busbar in the longitudinal direction.

The second busbar carries a first counterpart contact and a second counterpart contact, which are longitudinally spaced apart from each other. In this case, the distance is expediently greater than 4 mm, 5 mm or 1 cm. For example, the distance is less than 5 cm, 4 cm or 3 cm. Preferably, the distance is substantially equal to 2 cm, wherein in each case there is in particular a deviation of up to 10%, 5% or 0%. Due to such a distance, a comparatively compact electrical switching system is implemented.

Furthermore, the second busbar comprises a second power connection. In particular, the second power connection forms the longitudinal boundary of the second busbar, that is, one of the longitudinal ends of the second busbar. The second power connection is used to electrically connect the second busbar to further components of the electrical switching system. For example, the second power connection is configured as a clip. Alternatively, at the second power connection, the busbar merges into another component, so that the second busbar is formed onto another component by means of the second power connection and is thus integral therewith.

The first bus bar partially overlaps the second bus bar along the longitudinal direction. Also, the contacts and the counterpart contacts are located in the longitudinal direction between the two power connections in the overlapping region. Moreover, the second bus bar is mounted so as to be movable in a transverse direction perpendicular to the longitudinal direction. For this purpose, the electrical switching system has a corresponding guide or other mechanism. Thus, it is possible to displace the second busbar with respect to the first busbar. When the second busbar is displaced along the transverse direction, it is thus possible to change the distance between the first busbar and the second busbar. In particular, it is possible in this case to bring the first counterpart contact against the first busbar and/or the first contact, so that there is a mechanical and therefore an electrical connection between them. However, by means of displacing the second busbar along the transverse direction, it is also possible to move the first contact away from the first counterpart contact.

In summary, due to the displaceable mounting of the second busbar, it is particularly possible for the electrical switching system to assume two states, wherein in one state an electric current flow from the first power connection to the second power connection is possible via the two busbars. In this case, the contacts as well as the counterpart contacts preferably are used to conduct the electric current. In contrast, when the second busbar is spaced apart from the first busbar, an electric current flow from the first power connection to the second power connection via the busbar is preferably interrupted.

Due to the spacing of the contacts as well as the counterpart contacts in the longitudinal direction, a section of the respective busbar is formed between each of them, with which a part of the electric current is conducted in the electrically conductive state. In this case, the electric current is conducted in parallel with each another in the longitudinal direction in both busbars. As a result, magnetic fields are formed in the same direction, which is why a magnetic attraction force acts at least partially between the two conductor rails in this region. In particular, the force here is essentially proportional to the product of the electric current conducted by means of the contact or respectively counterpart contacts and the ratio of the distance between the contacts or respectively the counterpart contacts and the distance between the two busbars.

This magnetic force is directed in the opposite direction to the magnetic force forming in the contacts and the counterpart contacts. As a result, the forces resulting from an increasing electric current acting on the busbars are comparatively low. By means of a suitable mechanism, it is thus possible, in particular in the event of an overcurrent event, which would lead to damage to the electrical switching system, i.e. in particular in the event of a multiple of the maximum current or respectively rated current of the electrical switching system, to hold the second busbar against the first busbar, so that the formation of an arc is avoided. Thus, wear is reduced. Also, in this case, fusion of the contacts with the counterpart contacts or other components of the respective busbar is avoided, so that the electrical switching system can continue to be used after such an event. Thus, reliability is increased.

For example, the electrical switching system is a component of a relay. The electrical switching system is preferably a component of an overcurrent protection device, such as a circuit breaker, in particular according to IEC60947-2, or a protection. For example, the electrical switching system is a component of a circuit breaker or a disconnecting switch, that is in particular a switch with the capability of isolation/galvanic isolation, such as expediently a load-break switch. Alternatively, or in combination therewith, the electrical switching system is a component of a fuse disconnector. Preferably, the electrical switching system is a component of a circuit breaker, such as an appliance circuit breaker, in particular according to standard IEC60934. Expediently, the above devices are each overcurrent protection devices. The circuit breaker or another of the above-mentioned devices in particular has an actuating device. By means of the actuation device, the second busbar is in particular actuated, so that it is positioned with respect to the first busbar as a function of the electric current carried in each case. In particular, in the event of an overcurrent event, the second busbar is spaced apart from the first busbar. However, if the overcurrent is more than the maximum carrying capacity of the circuit breaker respectively of the respective device, or at least more than a certain limit value, expediently no spacing of the second busbar from the first busbar takes place, and an interruption is preferably effected by means of an overcurrent protection device or a further overcurrent protection device, in particular a fuse. In this case, due to the arrangement of the contacts as well as the counterpart contacts, spacing of the second busbar from the first busbar due to the acting magnetic fields is substantially prevented or can comparatively easily be prevented, in particular by means of a comparatively simple mechanism. Thus, the circuit breaker or respectively the respective device can continue to be used after such use.

The circuit breaker or respectively the respective device can have a detection device, by means of which the electric current conducted by the overcurrent protection member, i.e. the circuit breaker or the respective device, is detected. By means of the detection circuit, the actuating device is in particular actuated. For example, the two devices are formed by means of a common component, for example a bimetal/bimetal element, which is for example configured as a bimetal strip or bimetal snap disc. Alternatively, the overcurrent protection member is actuated magnetically, thermally, hydraulically or a combination thereof.

Preferably, the first contact covers the first counterpart contact in the transverse direction. Alternatively, or particularly preferably in combination therewith, the second contact covers the second counterpart contact in the transverse direction. Thus, the contacts and the counterpart contacts are the defined points, at which a transition of the electric current flow between the two busbars occurs. Preferably, by means of displacement of the second busbar, it is possible to bring the counterpart contacts against the respective contact, so that a mechanical direct connection is implemented. In other words, when an electric current is conducted by means of the electrical switching system, both the first contact is mechanically in direct contact with the first counterpart contact and the second contact is mechanically in direct contact with the second counterpart contact.

For example, the contacts or at least one of the contacts or the counterpart contacts or at least one of the counterpart contacts, are formed by means of the respective busbar itself. Alternatively, the contacts and/or the counterpart contacts are formed by means of the same material of the respective busbars, and these are molded onto each other and thus integral with each other. Particularly preferably, however, the contacts and/or the counterpart contacts are implemented by means of a separate component, which is preferably attached to the respective busbar, for example by means of welding. Preferably, the contacts or respectively the counterpart contacts are made of a material that is different from the busbars and preferably has a comparatively high melting point and/or a comparatively low burn-off resistance. Preferably, at least one of the contacts, preferably all of the contacts, and/or one of the counterpart contacts, advantageously all of the counterpart contacts, is/are created from a silver-based contact material. Preferably, the silver-based contact material is silver nickel (AgNi), silver tin oxide (AgSnO2), silver tungsten (AgW) or silver graphite (AgC). In this way, a comparatively robust contact or respectively counterpart contact is created.

For example, the first contact is formed by means of a cylinder. The first counterpart contact is also formed by means of a cylinder, for example. Particularly preferably, however, the first counterpart contact is formed in this case by means of a cylinder segment or, especially preferably, by means of a spherical segment. As a result, when the contact of the first contact with the first counterpart contact is created, a contact point is always implemented, and a tolerance compensation is provided. Therefore, a contact transition resistance is reduced. Alternatively, or more preferably in combination therewith, the second contact is formed by means of a cylinder, wherein the second counterpart contact is also formed by means of a cylinder segment or more preferably by means of a spherical segment. In an alternative thereto, the first contact is formed by means of a spherical segment and the first counterpart contact is formed by means of a cylinder and/or the second contact is formed by means of a spherical segment and the second counterpart contact is formed by means of a cylinder. In this way, a tolerance compensation is respectively provided, so that it is ensured that a mechanically direct contact is actually implemented between the contacts and the respective counterpart contact. In an alternative embodiment, both the first contact and the first counterpart contact are each formed by means of a cylinder segment, these being mounted at 90° to each another, so that an X is formed. Preferably, in this case, the second contact and the second counterpart contact are also designed as cylinder segments.

The first and/or second busbar is preferably made of a metal, wherein the metal is for example a copper, i.e. pure copper or a copper alloy, such as brass. Due to the use of the copper, a comparatively low ohmic resistance is provided, which increases an efficiency of the electrical switching system. Particularly preferably, the copper is provided with a coating made, for example, of a silver, a tin or a nickel. As a result, a connection of further components to the busbar is simplified, and damage and/or reaction, in particular oxidation, is avoided.

For example, the first busbar and/or the second busbar can be created by means of casting, milling, embossing or stamping. Thus, adaptation to different conditions is simplified. Preferably, the first busbar is designed as a metal strip. Alternatively, or particularly preferably in combination therewith, the second busbar is designed as a metal strip. In this way, a manufacture of the two busbars is simplified. A thickness of the metal strip is comparatively small in one dimension and, for example, between 0.8 mm and 5 mm. In particular, the thickness is perpendicular to the longitudinal direction. Preferably, a stamping process is used to manufacture the conductor rails such that they are stamped from a metal sheet. In other words, the conductor rails are to be designed as a punched bent part. Therefore, manufacturing is simplified and consequently manufacturing costs are reduced.

For example, the two conductor rails are arranged parallel to each other, so that they have the comparatively small thickness in the same direction. In particular, in this case, the smallest extent of the metal strips, i.e. the thickness, is parallel to the transverse direction. In other words, the metal strips forming the two busbars are arranged perpendicular to the transverse direction. Thus, connecting or at least forming the contacts or respectively counterpart contacts is simplified. Alternatively, the two busbars are arranged parallel to the transverse direction. Thus, robustness is increased, in particular in case of a movement of the second conductor rail in transverse direction against the first conductor rail via the contacts as well as the counterpart contacts, and a bending of the conductor rails is avoided. In summary, the second conductor rail is arranged parallel to the first conductor rail.

The second busbar can be arranged perpendicular to the first busbar. For example, the main extension direction of the second busbar is substantially perpendicular to the transverse direction, and the extension of the first busbar is substantially parallel to the transverse direction and to the longitudinal direction. Particularly preferably, however, the first bus bar is arranged substantially perpendicular to the transverse direction, and the second bus bar is arranged substantially parallel to the longitudinal direction and parallel to the transverse direction. Due to the perpendicular arrangement of the two conductor rails to each other, on the one hand a mechanical stability is increased. Also, it is possible to adapt the conductor rails to the corresponding fields of application. Additionally, when the second conductor rail is moved in the transverse direction, a space requirement perpendicular to the transverse direction and perpendicular to the longitudinal direction is reduced, so that a comparatively compact electrical switching system can be implemented.

The second busbar can have a projection directed towards the first busbar between the two counterpart contacts. In this case, even if the contacts are in direct mechanical contact with the respective counterpart contacts, the projection in particular continues to be spaced apart from the first busbar, so that uncontrolled current conduction, in particular the formation of an arc, is avoided. Alternatively, or in combination therewith, the first busbar has a projection between the two contacts directed towards the second busbar. Particularly preferably, however, the first busbar has no projection between the two contacts and is expediently smooth. This simplifies the manufacture of the first busbar.

Due to the projection, a distance between the first and second busbars is reduced, which increases the magnetic forces that push the two busbars towards each other. Additionally, a cross section of the second busbar is increased due to the projection, so that the ohmic resistance is reduced. In particular, the second or first busbar is designed as a metal strip and is arranged perpendicular to the first busbar, which simplifies the manufacture of the projection.

For example, the first busbar is rigidly arranged and, in particular, held stationary. Alternatively, the first busbar is also mounted so as to be movable in the transverse direction. Preferably, when the electrical switching system is opened, the first busbar is also moved in the transverse direction away from the second busbar. Particularly preferably, however, the first bus bar is spring-loaded in the transverse direction, wherein by means of the springs the first bus bar is pushed in the direction of the second bus bar. If the electrical switching system is in the electrically conductive state, the spring force is compressed by means of the second busbar or a force acting on the second busbar. Thus, there is a force-fit connection between the two busbars via the contacts as well as counterpart contacts, which is why a current flow via the contacts or counterpart contacts is improved. Also, in the event of a vibration of the electrical switching system, for example, there is no spacing of the contacts from the counterpart contacts and thus no formation of an arc. Additionally, the magnetic forces acting on the busbars, which push them apart, are at least partially compensated for by means of the spring-loading in the event of an increasing electric current flow, so that it is also possible to conduct a comparatively large electric current. Since the two longitudinally spaced-apart contacts as well as counterpart contacts are provided, wherein a magnetic force is created due to the arrangement of the power connections, which pushes the current bars towards each other, only a comparatively weak spring is required, so that, on the one hand, manufacture is simplified. On the other hand, it is not necessary to apply a comparatively large force to the second bus bar to compress the spring. Thus, a design of the electrical switching system is simplified, which further reduces manufacturing costs.

The circuit breaker can have an electrical switching system having a first bus bar extending in a longitudinal direction, carrying a first contact and a second contact spaced longitudinally therefrom, and having a first power connection, and a second bus bar extending in the longitudinal direction, carrying a first counterpart contact and a second counterpart contact spaced longitudinally therefrom, and having a second power connection. The second bus bar is mounted so as to be movable in a transverse direction perpendicular to the longitudinal direction, wherein the first bus bar partially overlaps the second bus bar along the longitudinal direction. In the longitudinal direction, the contacts and the counterpart contacts are arranged between the two power connections in the overlapping region. Furthermore, the circuit breaker comprises an actuating device, by means of which the second bus bar is actuated. In this context, by means of the actuating device the distance of the second busbar to the first busbar is adjusted. Preferably, it is possible by means of the actuating device to move each of the contacts against a respective one of the counterpart contacts and also to be spaced therefrom, suitably in the transverse direction. In particular, the actuating device is itself actuated in response to an electric current flowing through the circuit breaker, in particular by means of a detection device. The detection device comprises, for example, a corresponding sensor. Preferably, the circuit breaker is configured as a magnetic, thermal or hydraulic circuit breaker or a combination thereof.

Suitably, the circuit breaker can be a component of a power switch or a disconnecting switch, in particular a load-break switch. Disconnecting switch can mean, for example, a power switch with disconnector function and/or an integrated fuse. The load-break switch expediently comprises a fail-safe element, in particular an overcurrent protection element/protection device, such as a fuse, which is suitably electrically connected in series with the electrical switching system. Insofar as a comparatively large electric current flows via the electrical switching system, which would lead to damage if the electrical switching system is opened, in particular an interruption of the electric current is effected by means of the overcurrent protection element. Preferably, an overcurrent protection member is used in this case, the tripping time of which is shorter than the tripping time of the actuating device. Consequently, the electric current flow is interrupted due to the overcurrent protection member/overcurrent protection device and not due to the actuation of the electric switching system. Thus, after replacement of the overcurrent protection device, in particular the fuse, the circuit breaker continues to be operational. By contrast, in the event of an electric current, which would not cause damage if the electric switching system were opened, but which is greater than a certain limit value, for example, the electric current is interrupted by spacing the second busbar from the first busbar in the transverse direction. Thus, after resetting the second busbar or other components of the circuit breaker, the latter is ready for use again. In this case, a comparatively large number of switching operations is also possible due to the comparatively low burn-off, which is why costs are reduced and reliability is increased. In summary, the circuit breaker is again ready for use after interruption by means of the overcurrent protection device, in particular if the electric current flow has been terminated due to a further protection mechanism, for example by means of a further overcurrent protection device, in particular a fuse.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
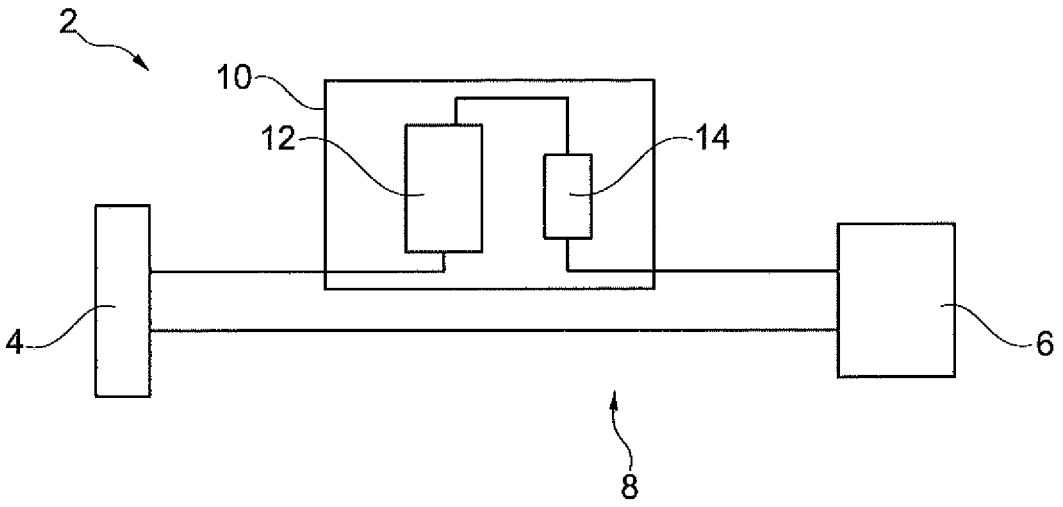
FIG. 1 shows a schematic diagram of an industrial plant with a circuit breaker.

In FIG. 1 a schematic diagram of an industrial plant 2 is shown, which has a power supply 4 and an actuator 6 operated by it. By means of the power supply 4 an electric alternating voltage with 50 Hz or 60 Hz is provided. In particular, the electrical voltage is 277 V or 480 V. The actuator 6 comprises, for example, an electric motor or a press and is electrically coupled to the power supply 4 by means of a line 8, so that the actuator 6 is supplied with current via the line 8.

Furthermore, the industrial plant 2 comprises a power switch 10, which in one embodiment is a part of the line 8 and is arranged in a control cabinet. In an alternative embodiment, the power switch 10 is arranged on the power supply 4 or on the actuator 6. The power switch 10 has a circuit breaker 12 and an overcurrent protection member 14 connected in series therewith. The electrical series connection is provided in one of the cores of the line 8.

In this example, the rated current of the power switch 10 is 60 A, and when the rated current is exceeded by more than a certain limit value, for example 1.1 times the rated current, the electric current flow is interrupted by means of the circuit breaker 12. In other words, in this case, the circuit breaker 12 is tripped and thus opened. The overcurrent protection member 14, on the other hand, does not trip in this case. Said overcurrent protection member 14 only trips from five times the rated current, i.e. from 300 A, wherein the tripping time is less than the tripping time of the circuit breaker 12. In this case, the electric current flow is thus interrupted by means of the overcurrent protection member 14, whereas the circuit breaker 12 continues to be in the electrically conductive state. Due to such an interconnection of the circuit breaker 12 and the overcurrent protection member 14, in case of a comparatively small exceeding of the rated current by the electric current, the power switch 10 is substantially immediately ready for operation by resetting the circuit breaker 12. Also, a replacement of components is not required, which reduces operating costs. However, if the overcurrent is comparatively large, in particular greater than 300 A, damage is possible when switching by means of the mechanically equipped circuit breaker 12. In this case, actually an arc occurs, which may cause a damage of components of the circuit breaker 12. Since the circuit breaker 12 is not tripped, it is not damaged, and the power switch 10 is also ready for use again after replacement of the overcurrent protection member 14.

Figure 2:
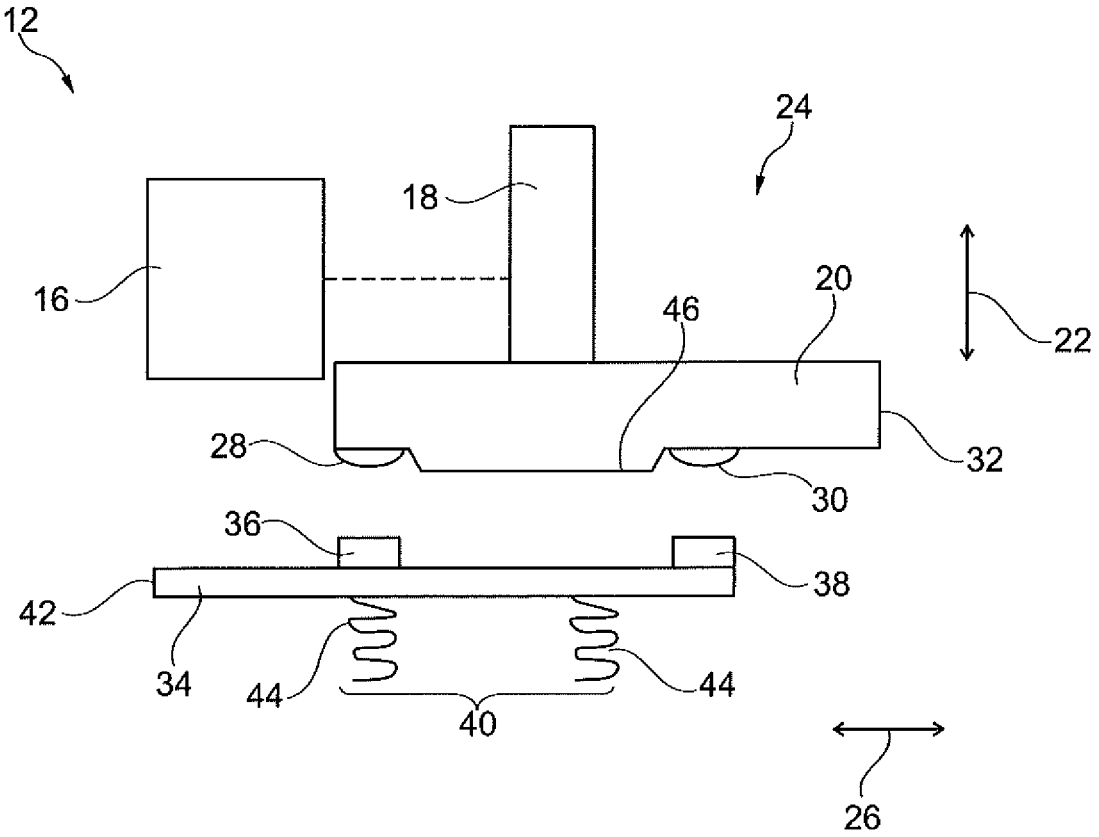
FIG. 2 shows the circuit breaker comprising an electrical switching system in an open state.
Figure 3:
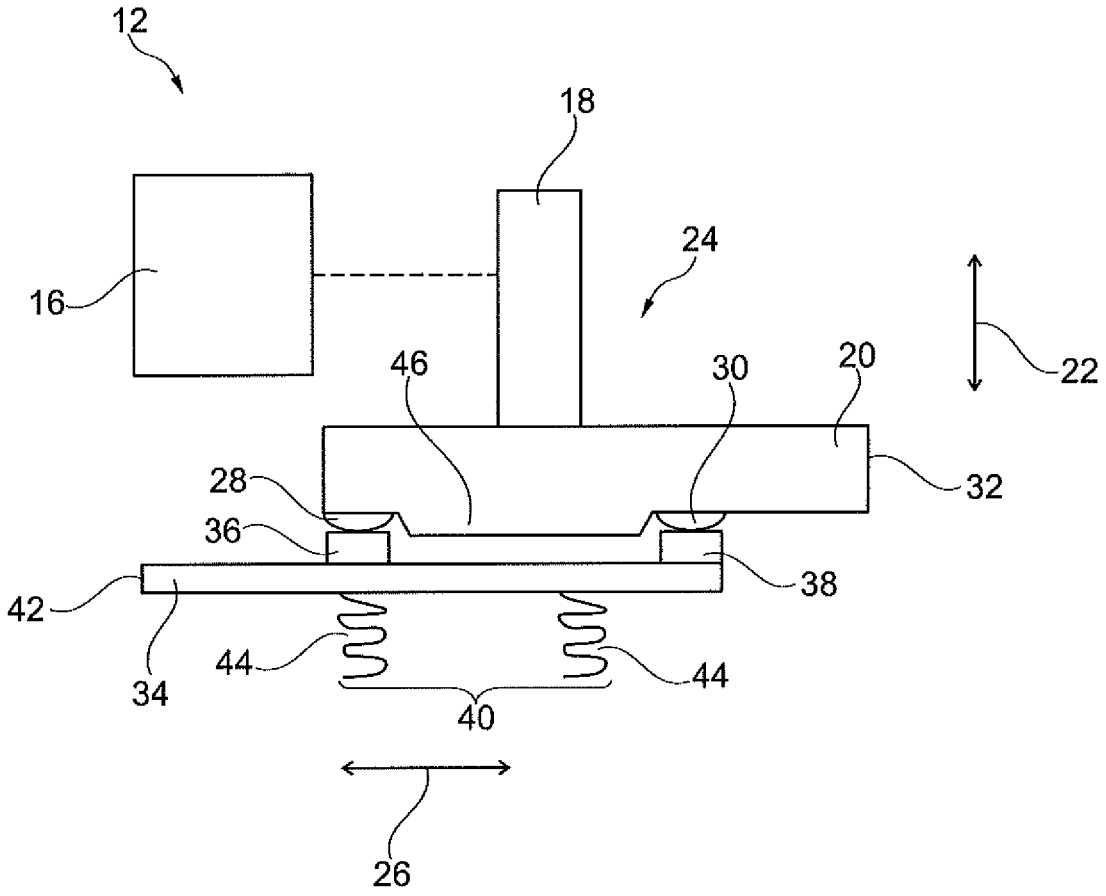
FIG. 3 shows the circuit breaker in a closed state.

FIG. 2 shows the circuit breaker 12 in an open state and FIG. 3 shows it in a partially schematic simplified closed state. The circuit breaker 12 has a detection device 16, by means of which the electric current conducted by the circuit breaker 12 is detected. By means of the detection device 16, an actuation device 18 is actuated and consequently driven. The detection device 16 and the actuating device 18 are implemented by means of a common component. In the variant shown, however, these are components separate from each another, and the detection device 16 is a bimetal, by means of which a spring-loaded mechanism is held in a certain position. During operation, the bimetallic latch 16 is traversed by the electric current conducted by means of the circuit breaker 12, and the spring-loaded mechanism is a component of the actuating device 18.

By means of the actuating device 18, a second busbar 20 is actuated and moved by means thereof in a transverse direction 22, wherein in the closed state and in the open state of the circuit breaker 12, the second busbar 20 is located at two different positions in the transverse direction 22. The second bus bar 20 is a component of an electrical switching system 24, which comprises a guide for the second bus bar 20, so that the second bus bar 20 can be moved in the transverse direction 22. Other movement of the second busbar 20, on the other hand, is prevented due to the guide. In other words, the second busbar 20 is mounted so as to be movable in the transverse direction 22.

The second bus bar 20 extends in a longitudinal direction 26, which is perpendicular to the transverse direction 22, and the second bus bar 20 is stamped from a metal sheet and is thus designed as a metal strip. The second bus bar 20 is stamped from a copper sheet and is also provided with a silver coating. The metal strip forming the second bus bar 20 is arranged parallel to the transverse direction 22, so that the second bus bar 20 has the smallest extension perpendicular to the transverse direction 22 and perpendicular to the longitudinal direction 26. The second busbar 20 extends substantially in the longitudinal direction 26, where it has the greatest extension.

A first counterpart contact 28 and a second counterpart contact 30 are connected to the second busbar 20, such as by means of welding, soldering, or riveting. In other words, the second busbar 20 carries the two counterpart contacts 28, 30, and the two counterpart contacts 28, 30 lie on a common straight line extending in the longitudinal direction 26. The two counterpart contacts 28, 30 are identical in construction to each other and are formed by means of a spherical segment. Also, the counterpart contacts 28, 30 are made of a material different from the busbar 20, namely a silver nickel (AgNi). The first counterpart contact 28 is connected in the region of one end of the second busbar 20 in the longitudinal direction 26, and the second counterpart contact 30 is spaced apart from the first counterpart contact 28 in the longitudinal direction 26, there being a distance of 2 cm between them. Furthermore, the second bus bar 20 has a second power connection 32 formed by means of the end of the second bus bar 20 opposite the first counterpart contact 28 in the longitudinal direction 26.

The electrical switching system 24 further comprises a first bus bar 34 made of the same material as the second bus bar 20. In other words, the first bus bar 34 is also a metal strip stamped from a copper sheet and provided by means of a nickel coating. The first bus bar 34 is oriented perpendicularly to the transverse direction 22, and thus extends mainly in the longitudinal direction 26 as well as transversely to the transverse direction 22. Consequently, the second bus bar 20 is arranged perpendicularly to the first bus bar 34. The first busbar 34 carries a first contact 36 and a second contact 38, which are identical in construction to each other. The contacts 36, 38 are cylindrical in shape and thus formed by means of a cylinder. Also, the contacts 36, 38 are made of the same material as the counterpart contacts 28, 30, namely silver nickel (AgNi).

The two contacts 36, 38 lie on a common straight line extending in the longitudinal direction 26 and are arranged congruently with the counterpart contacts 28, 30. In this context, the first contact 36 is associated in the first counterpart contact 28 and the second contact 38 is associated in the second counterpart contact 30. Consequently, when the second busbar 20 is moved in the transverse direction 22 towards the first busbar 34, the first counterpart contact 28 is brought against the first contact 36 and the second counterpart contact 30 is brought against the second contact 38, so that they are in direct mechanical contact with each other. In summary, the first contact 36 overlaps the first counterpart contact 28, and the second contact 38 overlaps the second counterpart contact 30 in the transverse direction 22. In other words, the contacts 36, 38 and the respective counterpart contacts 28, 30 are arranged parallel to and directly above each other. Consequently, the two contacts 36, 38 are also spaced apart from each other in the longitudinal direction 26, namely by 2 cm, wherein the second contact 38 is connected to one end of the first busbar 34 in the longitudinal direction.

Consequently, the two busbars 20, 34 overlap in the longitudinal direction 26 to form an overlap region 40. In this case, the first bus bar 34 overlaps the overlap region 40 on one side of the overlap region 40 in the longitudinal direction 26 and the second bus bar 20 overlaps the overlap region 40 on the opposite side in the longitudinal direction 26. The overlap region 40 is thus substantially equal to 2 cm plus the extent of the counterpart contacts 28, 30 or the contacts 36, 38 in the longitudinal direction 26.

The first bus bar 34 has a first power connection 42 forming the end of the first bus bar 34 opposite the second contact 38. Consequently, the first power connection 42, as well as the second power connection 32, is arranged outside the overlap region 40. Thus, the contacts 36, 38 as well as the counterpart contacts 28, 30 are arranged in the longitudinal direction 26 between the two power connections 32, 42 in the overlap region 40.

Furthermore, the electrical switching system 24 has two springs 44 that are spaced apart from each other in the longitudinal direction 26 and oriented in the transverse direction 22. The two springs 44 are supported on a housing and the first bus bar 34, such that the first bus bar 34 is spring-loaded in the transverse direction 22.

During operation of circuit breaker 12, the two power connections 32, 42 are connected to other components of the power switch 10. To conduct current by means of the circuit breaker 12, the electrical switching system 24 is put in the electrically conductive state. For this purpose, the second busbar 20 is moved in the transverse direction 22, so that the counterpart contacts 28, 30 press against the contacts 36, 38. In particular, the second busbar 20 is locked in the position shown in FIG. 3 by means of the actuating device 28. In this case, the force applied to the second busbar 20 by means of the actuation device 18 is such that the first busbar 34 is also moved in the transverse direction 22 and the springs 44 are compressed. As a result, a force-fit contact is implemented between the contacts 36, 38 as well as the corresponding counterpart contacts 28, 30. As a result, the electric current can flow via the first power connection 42 into the first busbar 34 and there partially via the first contact 36 as well as the first counterpart contact 28 into the second busbar 20. Another part of the electric current is introduced into the second busbar 20 via the second contact 38 as well as the second counterpart contact 30. The electric current is conducted out of the second busbar 20 via the second power connection 32.

As a consequence thereof, the electric current flows in parallel in the transverse direction 22 in the two contacts 36, 38 and the associated counterpart contacts 28, 30. Furthermore, the electric current flows in parallel in the longitudinal direction 26 in the two busbars 20, 34 in the overlap region 40. Thus, a rectified magnetic field is formed in each of the two busbars 20, 34 in the overlap region 40, which presses the two busbars 20, 34 towards each other in the overlap region 40. To enhance this effect, the second bus bar 20 has a projection 46 directed towards the first bus bar 34 in the overlap region 40 between the two counterpart contacts 28, 30. The projection 46 forms an end at the second busbar 20 in the transverse direction 22, so that the counterpart contacts 28, 30 are recessed in the transverse direction 22 with respect to the projection 46. However, the projection 46 is spaced apart from the first busbar 34, which is why a jumping over of the electric current from the first busbar 34 directly onto the second busbar 20, in particular the projection 46, is avoided. The force pushing the two bus bars 20, 34 towards each other increases with increasing electric current and counteracts any force pushing the bus bars 20, 34 apart in the transverse direction 22. One such force in particular a magnetic force caused due to the electric current flowing in the transverse direction 22.

Due to the at least partial compensation of the force pushing the two busbars 20, 34 apart, the busbars 20, 34 are not pushed apart in an uncontrolled manner even in the case of a comparatively large electric current, which could lead to a burn-off of the contacts 36, 38 and the counterpart contacts 28, 30 and a partially melting of these. If actually the partially melted contacts 36, 38 or respectively the counterpart contacts 28, 30 would be placed on top of each other again, they would fuse, which is why it would not be possible to move the second busbar 20 in the transverse direction 22 again. Therefore, in the event of such a large electric current, which is at least five times the rated current, the overcurrent protection member 14 is tripped, which is why the electric current is cut off. In this case, however, the electrical switching system 24 continues to be in the electrically conductive state.

If, by contrast, a comparatively small overcurrent occurs, this is detected accordingly by means of the detection device 16. As a result, the actuating device 18 is actuated and consequently the second bus bar 20 is lifted in the transverse direction 22 from the first bus bar 34. Therefore, an electric current flow between the first and second power connections 42, 32 is interrupted. In this case, the switched electric current is comparatively low, so that damage to the contacts 36, 38 and the counterpart contacts 28, 30 does not occur.

The invention is not limited to the above-described embodiment example. Rather, other variants of the invention can also be derived therefrom by the expert without leaving the object of the invention. Furthermore, in particular, all individual features described in connection with the embodiment examples can also be combined with each other in other ways without leaving the object of the invention.

What is claimed is:

1. An electrical switching system of a circuit breaker, the electrical switching system comprising:

a first busbar extending in a longitudinal direction that carries a first contact and a second contact spaced apart from the first contact in the longitudinal direction and a first power connection; and a second busbar extending in the longitudinal direction, which carries a first counterpart contact and a second counterpart contact spaced apart from the first counterpart contact in the longitudinal direction and a second power connection, wherein the second busbar is mounted so as to be movable in a transverse direction substantially perpendicularly to the longitudinal direction, wherein the first busbar partially overlaps the second busbar along the longitudinal direction in an overlap region, and wherein the overlap region is provided between the first and second power connections in the longitudinal direction and the first and second contacts and the first and second counterpart contacts are arranged in the overlap region in the longitudinal direction, such that the first and second contacts and the first and second counterpart contacts are arranged between the first and second power connections in the longitudinal direction.

2. The electrical switching system according to claim 1, wherein the first contact is aligned with the first counterpart contact and the second contact is aligned with the second counterpart contact in the transverse direction.

3. The electrical switching system according to claim 2, wherein the first contact is formed by a cylinder and the first counterpart contact is formed by a spherical segment.

4. The electrical switching system according to claim 1, wherein the first busbar and the second busbar are metal strips.

5. The electrical switching system according to claim 1, wherein between the first and second counterpart contacts, the second busbar has a projection directed towards the first busbar.

6. The electrical switching system according to claim 1, wherein the first busbar is spring-loaded in the transverse direction.

7. A circuit breaker comprising:

an actuating device; and the electrical switching system according to claim 1, wherein the second busbar is actuated so as to move in the transverse direction by the actuating device.

8. The electrical switching system according to claim 1, wherein the first and second contacts and the first and second counterpart contacts are formed of a conductive material.

* * * * *